US007513069B1

(12) United States Patent
Gamble, II et al.

(10) Patent No.: US 7,513,069 B1
(45) Date of Patent: Apr. 7, 2009

(54) SNOW PLOW JACK STAND

(75) Inventors: Robert N. Gamble, II, Watertown, WI (US); Mark D. Buckbee, Wauwatosa, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 12/140,903

(22) Filed: Jun. 17, 2008

(51) Int. Cl.
*E01H 5/04* (2006.01)

(52) U.S. Cl. ..... 37/231

(58) Field of Classification Search ..... 37/231–236, 37/270, 271, 266; 172/272–275, 212, 395, 172/810, 811, 817
See application file for complete search history.

(56) References Cited

U.S. PATENT DOCUMENTS

| | | | | |
|---|---|---|---|---|
| 5,092,409 | A | 3/1992 | Defrancq | |
| 5,195,261 | A | 3/1993 | Vachon | |
| 5,894,688 | A | 4/1999 | Struck et al. | |
| 5,924,223 | A | 7/1999 | Hone, Jr. | |
| 6,151,808 | A | 11/2000 | Curtis | |
| 6,209,231 | B1 | 4/2001 | Curtis | |
| 6,240,659 | B1 | 6/2001 | Curtis et al. | |
| 6,314,666 | B1 | 11/2001 | Klemenhagen et al. | |
| 6,363,629 | B1 | 4/2002 | Curtis | |
| 6,618,964 | B2 | 9/2003 | Kost et al. | |
| 6,775,933 | B2 | 8/2004 | Koch et al. | |
| 6,944,978 | B2 | 9/2005 | LeBlond et al. | |
| 7,103,995 | B2 | 9/2006 | Curtis | |
| 7,117,617 | B2 | 10/2006 | Kost et al. | |
| 7,146,754 | B2 | 12/2006 | Schultz et al. | |
| 7,228,650 | B2 | 6/2007 | Curtis | |
| 7,334,357 | B1 * | 2/2008 | Altheide | 37/231 |
| 7,353,628 | B2 * | 4/2008 | Potak | 37/231 |
| 2005/0144814 | A1 | 7/2005 | Potak | |

* cited by examiner

*Primary Examiner*—Robert E Pezzuto
(74) *Attorney, Agent, or Firm*—Reinhart Boerner Van Deuren s.c.

(57) ABSTRACT

A jack stand for a snow removal system including an easily vertically positionable frame retaining bracket and locking mechanism is provided. The jack stand is configurable between a lowered, operational position and a raised, stored position, wherein the jack stand includes a locking mechanism for retaining the base of the jack stand on the ground. When the jack stand is not needed, the locking mechanism is released, the jack stand is raised from the ground and the stand remains secured to the hitching mechanism and stored for further use thereof.

14 Claims, 7 Drawing Sheets

36
38
30
70
56
210
5
5
34
32

42
184
182
50
169
133
44
150
174
158
172
148
122
142a
134a
140
136a
48a
144a
134b
144b
136b
48b
46
128
142b
134c
136c
48c
144c
142c
134d
136d
48d
144d
142d
138d
170
180
168
162
52
166
40

SNOW PLOW JACK STAND

IDENTIFICATION OF RELATE APPLICATIONS

This patent application is related to co-pending U.S. patent application Ser. No. 12/140,893, entitled "Removable And Storable Wings For A Snow Plow Blade And Snow Removal System Used Therewith," co-pending U.S. patent application Ser. No. 12/140,886, entitled "Snow Plow Blade Including Nut Retaining Plate," co-pending U.S. patent application Ser. No. 12/140,732, entitled "Plow Quick Connect/Disconnect Hitch Mechanism," co-pending U.S. patent application Ser. No. 12/140,635, entitled "V-Plow," and co pending U.S. patent application Ser. No. 12/140,671, entitled "Plow Including Independently Moveable Wings," all of which patent applications were filed on Jun. 17, 2008, and all of which patent applications are assigned to the assignee of the present application, and all five of which patent applications are hereby incorporated herein by reference in their entirety.

BACKGROUND OF THE INVENTION

Field of the Invention

The present invention relates generally to snow removal systems for medium and light duty trucks, and particularly to a jack stand for safe and easy installation and removal of a snow plow blade on to a snow plow hitch component of the snow removal system.

The type of vehicle used in a snow removal system depends on the particular plowing application, and can include medium or light duty trucks, a skid or front-end loaders or commercial/government vehicles. Typically, the snow plowing apparatus is configured to be connected and disconnected from the snow plow vehicle so that the vehicle can be used in other applications, when not needed.

In order to provide the detachable plowing apparatus to the snow plow vehicle, a conventional snow removal system includes a hitch frame nose piece mounted at the front of the vehicle under the bumper, a hitch mechanism, removably mounted to the hitch frame nose piece on the vehicle, and a snow plow blade, mounted to the hitch mechanism. When attaching and removing snow plow equipment from the vehicle, the snow plow hitch mechanism must be raised to a vertical position so that it may be substantially aligned with and secured to the hitch on the front bumper of the vehicle.

Despite efforts to reduce the overall weight of the snow removal components, together the hitch mechanism and snow plow blade are extremely large and heavy, weighing up to several hundred pounds. In prior art snow removal systems, the plow operator must lift the system with pry bars or a hoist when performing this operation, and many times more than one individual is required. However, this can result in pinched fingers and back injuries to the operator(s).

It is accordingly the primary objective of the present invention that it provide an improved snow plow jack stand for a snow removal system and method of operating the same which allows the snow plow to be both connected to and disconnected from a vehicle easily and simply, without requiring tools. It is a related objective of the snow plow jack stand for a snow removal system of the present invention that it require little physical effort to connect or disconnect the snow plow from the vehicle. It is another related objective of the snow plow jack stand for a snow removal system of the present invention that the process of connecting or disconnecting the snow plow to or from the vehicle is so simple and easy to use that it can be done by a single person without requiring assistance.

It is a further objective of the snow plow jack stand for a snow removal system of the present invention that it be mechanically simple both in construction and in operation. It is a still further objective of the snow plow jack stand for a snow removal system of the present invention that is durable, long lasting and configured to be securably mounted to the snow plow hitch mechanism for easy availability whenever it is desired to remove the plow from the vehicle.

SUMMARY OF THE INVENTION

The disadvantages and limitations of the background art discussed above are overcome by the present invention. With this invention, a snow plow jack stand for a snow removal system is provided for safe and efficient removal, installation and storage of a snow plow blade system.

The jack stand of the present invention includes a stand base, a vertical shaft pivotally mounted thereto, a mounting bracket for securing the jack stand to a frame component of the hitch mechanism, upper and lower spring components and a locking mechanism for locking the vertical shaft into the desired position.

The jack stand has a lowered or operational position such that the jack stand base is positioned on the ground and the hitch mechanism is maintained at the proper vertical height before installation of the hitch mechanism on to the plowing vehicle. In the raised or stored position, the locking mechanism is released and the vertical shaft moves upwardly, lifting the stand base from ground level. The lower spring provides upward pressure on the locking mechanism so that the edges of the locking mechanism contact and grip the side edges of the vertical shaft locking the vertical shaft it into place.

When downward pressure is applied to the handle on the vertical shaft, the locking mechanism pivots downwardly releasing contact with the vertical shaft. When the locking mechanism is pivoted in this manner, a space is provided between the locking mechanism and the vertical shaft so that the shaft may slide up and down within the openings thereof.

As such, to maintain the plow hitch mechanism at the desired vertical position for installation on to the vehicle, the operator applies downward pressure to the handle of the vertical shaft causing the spring to expand and the stand base to rest on the ground. When the base contacts the ground and the handle is released, the lower spring urges the locking mechanism upwardly so that it engages the vertical shaft, thereby locking the jack in the proper position.

When it is desired to store the jack stand for plowing, downward pressure is applied to the release handle of the locking mechanism, releasing contact of the locking mechanism with the vertical shaft. The upper spring then releases from its tensioned or compressed position, causing the jack stand to leave the ground return to its raised, stored position.

The snow plow jack stand for a snow removal system of the present invention is of a construction which is both durable and long lasting, and which will require little or no maintenance to be provided by the user throughout its operating lifetime. The snow plow jack stand for a snow removal system of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
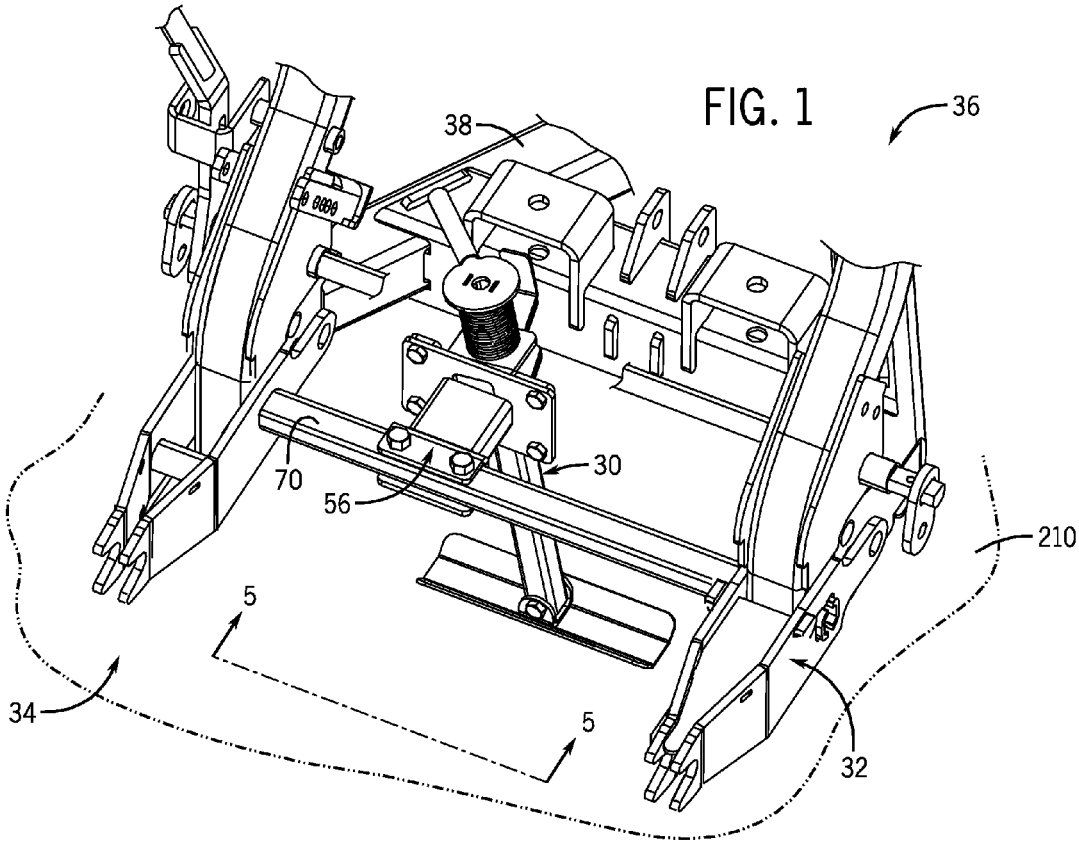
FIG. 1 is a front perspective view of a snow plow jack stand for a snow removal system of the present invention, shown in the installed position on a snow plow hitch mechanism.

A snow plow jack stand 30 for a snow removal system of the present invention is illustrated in FIGS. 1 through 10. The snow plow jack stand 30 is illustrated on a conventional snow plow hitch mechanism, indicated generally at 32, having a rear facing side 34 that will be attached to the front of a snow plow vehicle (not shown), and a front facing side 36, which including an A-frame component 38 for supporting and connecting components, such as a snow plow blade (not shown) to the snow removal system, as will be known to those skilled in the art. The hitch mechanism 32 is provided as only one example of the type of hitch/lift mechanism design and/or frame assembly that can be utilized with the jack stand of the present invention. It will be appreciated that one or more features of the jack stand 30 of the present invention can be incorporated into any type of hitch mechanism/attachment frame assembly, with little or no modification thereof.

Figure 2:
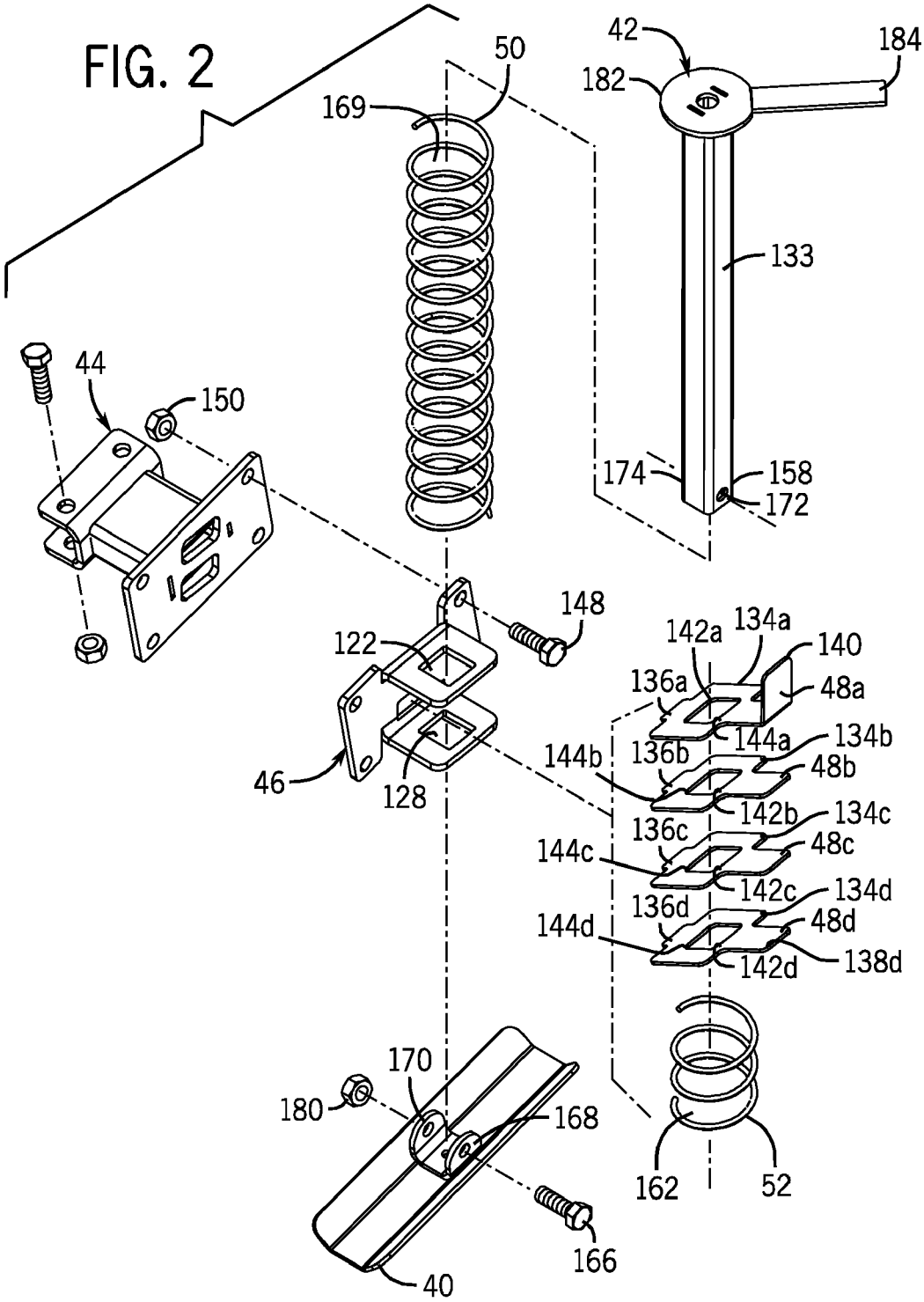
FIG. 2 is an exploded view the snow plow jack stand illustrated in FIG. 1.

Referring first to FIGS. 1 and 2, the snow plow jack stand 30 includes a stand base 40 and a substantially vertically oriented shaft 42 pivotally mounted thereto. The jack stand 30 further includes a mounting bracket 44, support bracket 46, a plurality of overlapping locking plates 48*a* through 48*d* and upper and lower tensioning members/biasing members such as springs, indicated generally at 50 and 52. It will be appreciated that each of the components of the jack stand are preferably constructed of a metal material, such as steel, aluminum or another lightweight metal, alloy or composite material capable of withstanding the environmental and wear conditions usually encountered during removal, storage, installation and operation of the snow removal system.

Figure 3:
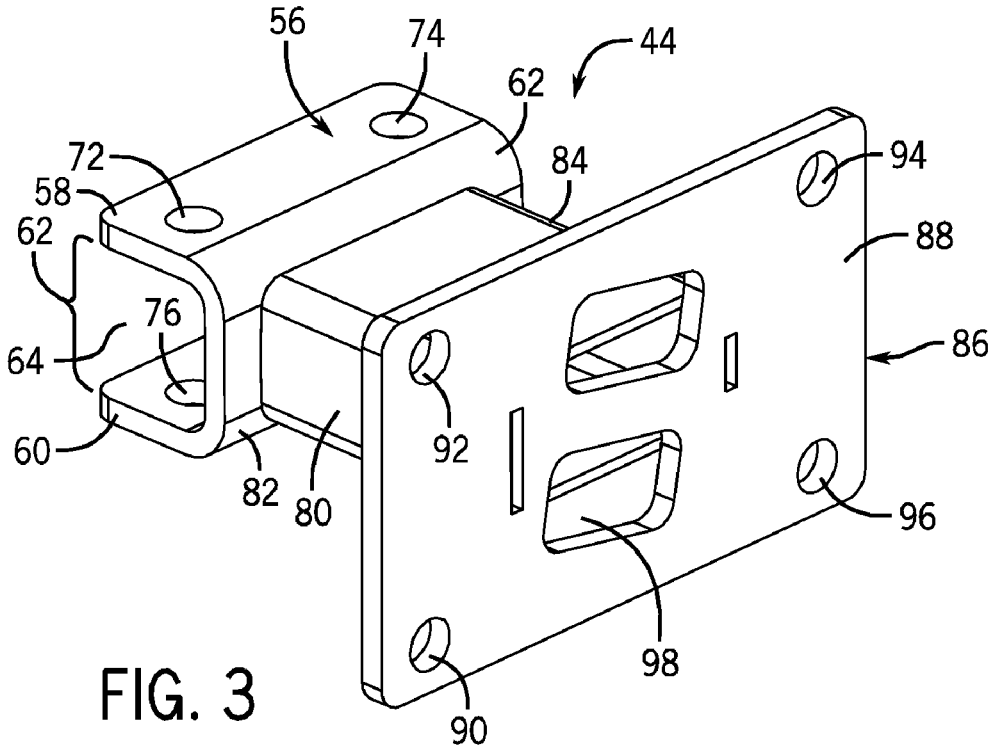
FIG. 3 is a perspective view of a mounting bracket for the snow plow jack stand illustrated in FIGS. 1 and 2.

Turning to FIG. 3, in addition to FIGS. 1 and 2, the mounting bracket 44 includes a hitch mounting portion 56, such as a substantially U-shaped channel member, comprising upper and lower, substantially parallel plates 58 and 60 and a connecting portion 62. The upper plate 58 and lower plate 60 are spaced apart a distance 62 to provide an area 64 for accommodating a horizontally oriented mounting bar or brace 70 on the hitch mechanism 32. The upper plate 58 includes at least one, and preferably two apertures 72 and 74 formed therein. Likewise, the lower plate 60 includes preferably two apertures 76 and 78, configured to axially align with the apertures 72 and 74 in the upper plate 58.

The mounting bracket 44 further includes an extension 80, such as a square or tubular hollow member, secured at one end 82 to the mounting portion 56 and secured at the other end 84 to a substantially planar support plate 86. The support plate 86 is substantially vertically oriented presenting a front face 88 configured to mate with the support bracket 46, as described in more detail below. Preferably, the support plate 86 is substantially rectangular in shape, having mounting apertures 90, 92, 94 and 96 formed in respective corners thereof. An opening 98 is also formed in the support plate 86 for accommodating the locking plates 48*a*-48*d*, as will also be described in more detail below.

Figure 4:
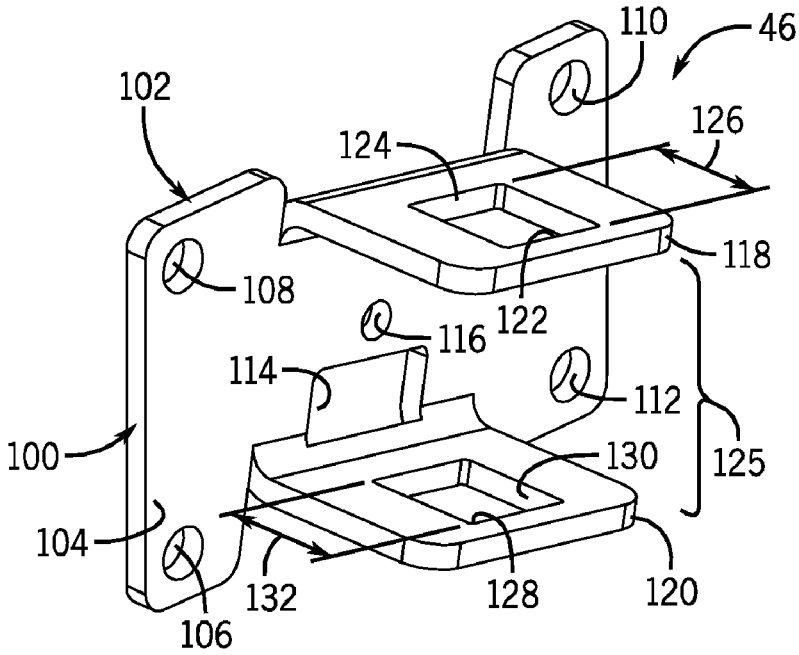
FIG. 4 is a perspective view of a locking bracket for the snow plow jack stand illustrated in FIGS. 1 through 3.

Turning to FIG. 4, in addition to FIGS. 1 and 2, the support bracket 46 is preferably formed of a single piece of material and includes a substantially planar, vertically oriented back plate, indicated generally at 100, having a rear side 102 that will mate with the front face 88 of the support plate 86 and a front side 104. The back plate 100 includes mounting apertures 106, 108, 110 and 112 formed therein and positioned within the back plate 100 to axially align with the apertures 90, 92, 94 and 96 in the support plate. An opening 114 is also formed in the back plate 100 configured to substantially align with the opening 98 in the mounting bracket, which is also for accommodating the locking plates 48*a*-48*d*, as will also be described in more detail below. Additional mounting apertures, such as aperture 116 can also be provided in the support bracket, as necessary.

Substantially horizontal and parallel upper and lower arms 118 and 120 extend forwardly from the front side 104 of the back plate 100 of the support bracket 44. It will be appreciated that the arms 118 and 120 are preferably integrally formed with the back plate 100 of the support bracket 46. The upper arm 118 includes an opening 122 formed therein. The opening 122 has side edges, indicated generally at 124, an is of a size 126 configured to accommodate the shaft 42. Likewise, the lower arm 120 includes an opening 128 formed therein. The opening 128 has side edges, indicated generally at 130, an is of a size 132 configured to accommodate the outside edges 133 of the shaft 42. The arms 118 and 120 are spaced apart a distance 125 apart so that the spring 52 and the locking plates 48*a* through 48*d* therebetween.

Figure 9:
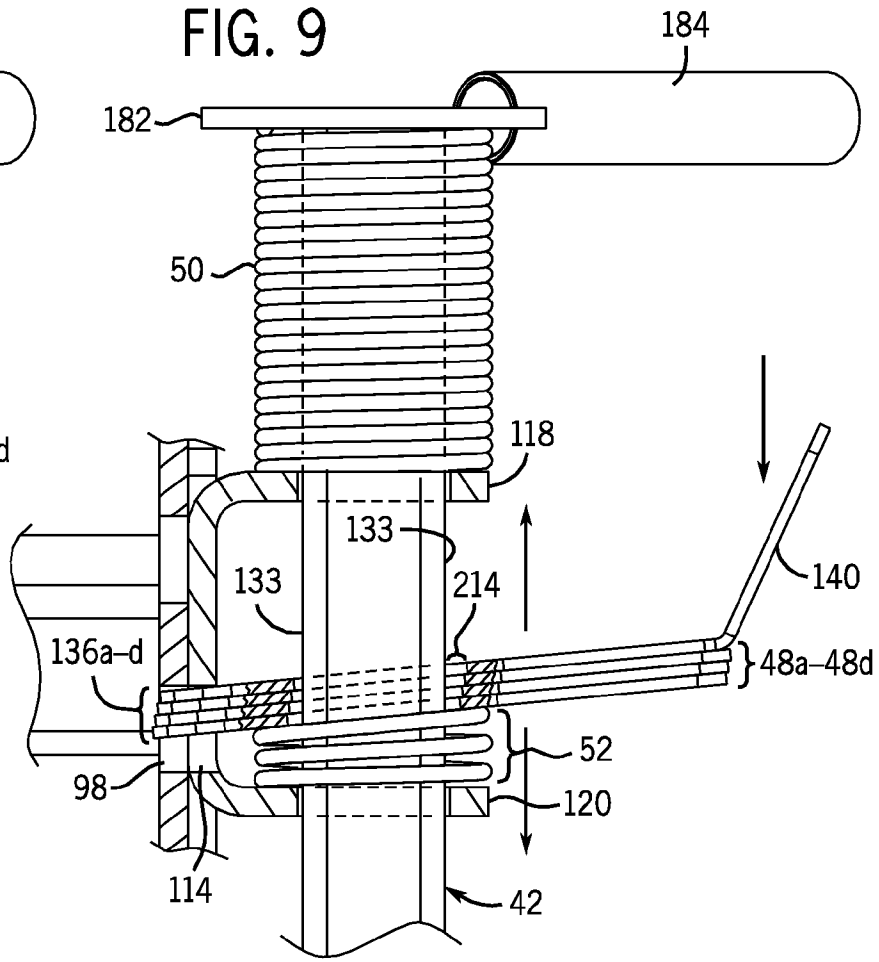
FIG. 9 is partial view of the jack stand illustrated in FIGS. 1 through 8, shown in the an unlocked position.
Figure 8:
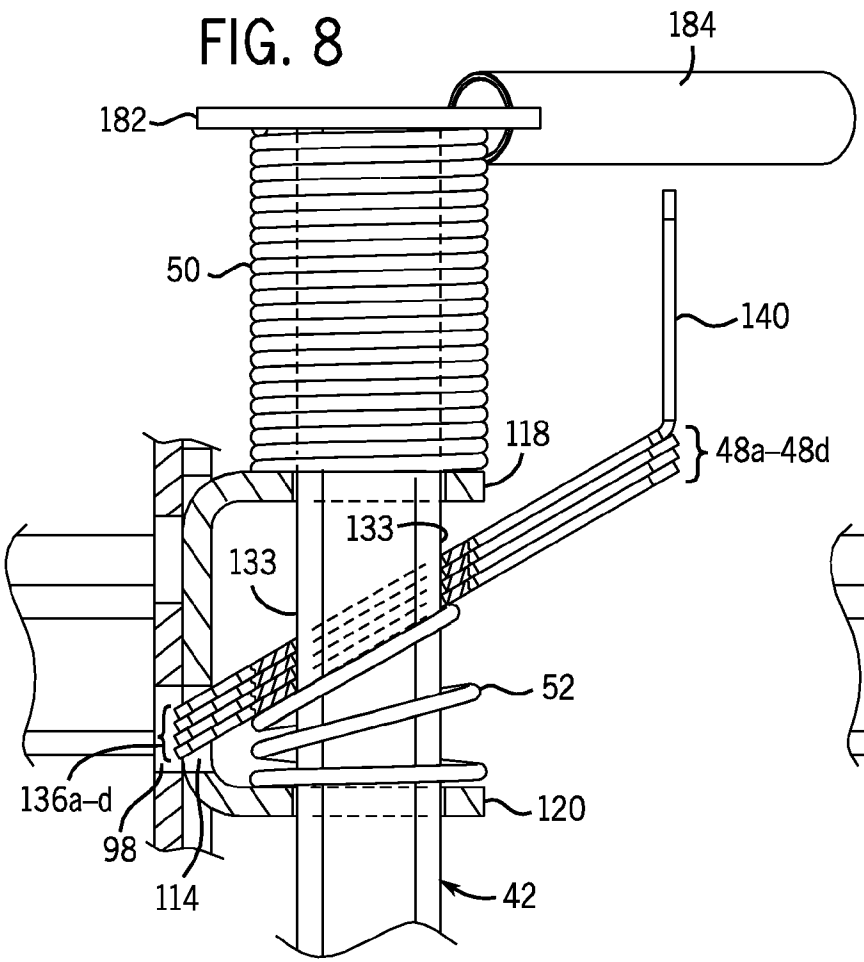
FIG. 8 is partial view of the jack stand illustrated in FIGS. 1 through 7, taken along the line 8-8 in FIG. 5, shown in a locked position.

As best illustrated in FIG. 2, each of the locking plates 48*a* through 48*d* have a substantially flat plate body 134*a*, 134*b*, 134*c* and 134*d* including a small lip or protrusion 136*a*, 136*b*, 136*c* and 136*d*, extending rearwardly therefrom. Each of the lips 136*a*, 136*b*, 136*c* and 136*d* are positioned to fit within the opening 114 in the back plate 100 of the support bracket 46 and are long enough to fit at least partially through the opening 98 in the mounting bracket 44, as illustrated in FIGS. 8 and 9. Preferably, each of the lips 136*a*, 136*b*, 136*c* and 136*d* are of a size that permits at least some pivotal movement of the locking plates 48*a*, 48*b*, 48*c* and 48*d*, respectively, when they are positioned within the openings 114 and 98.

Figure 6:
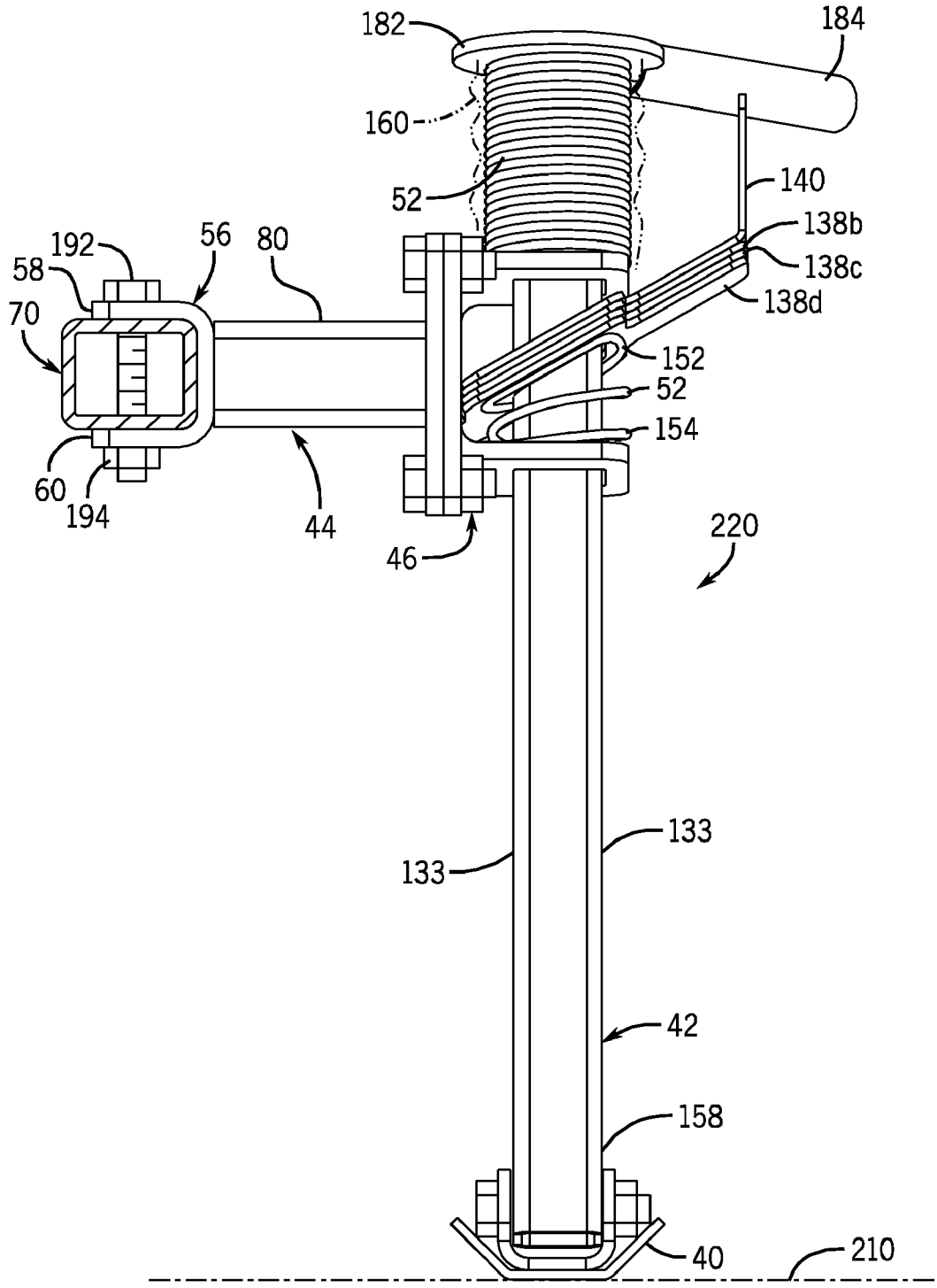
FIG. 6 is partial side view of the snow plow jack stand illustrated in FIGS. 1 through 5, taken along the line 6-6 in FIG. 5, shown in a lowered, operational position.

As illustrated in FIG. 6, each of the bottom three locking plates 48*b*, 48*c* and 48*d* includes a tab 138*b*, 138*c* and 138*d*, respectively, extending forwardly from the plate body 134*b*, 134*c* and 134*d*. Preferably, the top locking plate 48*a* includes an upwardly extending tab 140 that can be used as a jack release handle, as will be described.

Each of the locking plates 48*a*, 48*b*, 48*c* and 48*d* have an opening 142*a*, 142*b*, 142*c* and 142*d*, respectively, formed within the plate body 134*a*, 134*b*, 134*c* and 134*d* thereof. Each opening 142*a* through 142*d* has perimetral side edges, indicated generally at 144*a*, 144*b*, 144*c* and 144*d*, and is of a size configured to accommodate the outside perimetral edges 133 of the shaft 42 so that when the locking plates are positioned in a substantially horizontal manner on the shaft 42, the shaft 42 may slide up and down within the openings 142*a* through 142*d*.

The jack stand 30 is assembled by aligning the apertures 90, 92, 94 and 96 in the mounting bracket 44 with the mounting apertures 106, 108, 110 and 112 in the support bracket 46 and securing them together using a fastener such as bolts 148 and nuts 150. Other types of fasteners can be used, as will be well known to those skilled in the art.

The locking plates 48*a* through 48*d* are positioned overlying each other so that the plate 48*a* is the top plate. The locking plates 48*a* through 48*d* are positioned so that the substantially overlapping lips 136*a* through 136*d* thereof are positioned through the opening 114 in the support bracket 46 and at least partially through the opening 98 in the mounting bracket. It will be appreciated that although four locking plates are illustrated in the Figs., any number of locking plates can be used, such as three or five locking plates, configured in the manner described herein.

The spring 52 is positioned underneath the lowest locking plate 48*d* between the upper and lower arms 118 and 120 of the support bracket 46. When positioned between the arms 118 and 120, an end 152 of the spring 52 contacts the bottom locking plate 48*d* and the other end 154 of the spring 52 contacts the lower arm 120 of the support bracket 46. It will be appreciated that the spring 52 will be at least partially compressed, and under tension when properly positioned between the upper and lower arms of the support bracket 46. As such, the locking plates 48*a* through 48*d*, each having a lip engaging and pivotally fixed within the opening 114 in the support bracket 46 and the opening 98 in the mounting bracket, are disposed at an angle, such that the perimetral edges 144*a-d* of each of the apertures 142*a-d* of the locking plates 48*a-d* contact and grip the perimetral side edges 133 of the shaft 42, as illustrated in FIG. 8.

A top end 182 of the shaft 42 includes a handle 184 for lowering the jack so that the stand base rests on the ground, as will be described herein. A bottom end 158 of the shaft 42 is inserted through a central opening 169 of the upper spring 50 and a protective sleeve or jacket 160 can be provided over the spring 52 to protect the user's fingers during operation of the jack stand 30. The bottom end 158 of the shaft 52 is then inserted into the opening 122 of the upper arm 118, through the openings 142*a* through 142*d* in the overlying locking plates 48*a* through 48*d*, through a central opening 162 of the spring 52 and through the lower opening 128 in the lower arm 120. The bottom end 158 of the shaft 42 includes coaxially aligned apertures 172 and 174 is pivotally secured to the stand base 40 by inserting a bolt 166 through the mounting aperture 168, then through the apertures 172 and 174 and then through the aperture 170 in the stand base 40. The bolt 166 is secured in place with a nut 180.

The jack stand 30 is then installed on to the mounting brace 70 of the hitch mechanism 32. The mounting brace 70 is preferably provided with pretapped or drilled apertures 190 on the top and bottom sides of the mounting brace 70. The mounting brace 70 is positioned inside the area 64 between the upper and lower plates 58 and 60 of the mounting bracket 44. A bolt 192 is inserted through the aperture 72 in the upper plate 58, through the axially aligned apertures 190 in the mounting brace 70, through the aperture 76 in the lower plate 60 of the mounting bracket 44 and secured with a nut 194. Likewise, a bolt 198 is inserted through the aperture 74 in the upper plate 58, through the axially aligned apertures 190 in the mounting brace 70, through the aperture 78 in the lower plate 60 of the mounting bracket 44 and secured with a nut 200.

Turning next to FIGS. 6 through 9, in addition to FIGS. 1 through 5, operation of the jack stand 30 is described. As illustrated in FIG. 6, the stand base 40 of the jack stand 30 is positioned on the ground or surface 210 in the lowered, operational position 220, maintaining the hitch mechanism at a proper vertical level. It will be appreciated that the shaft 42 pivots with respect to the stand base 40 to account for mounting surfaces 210 that are not level.

Figure 7:
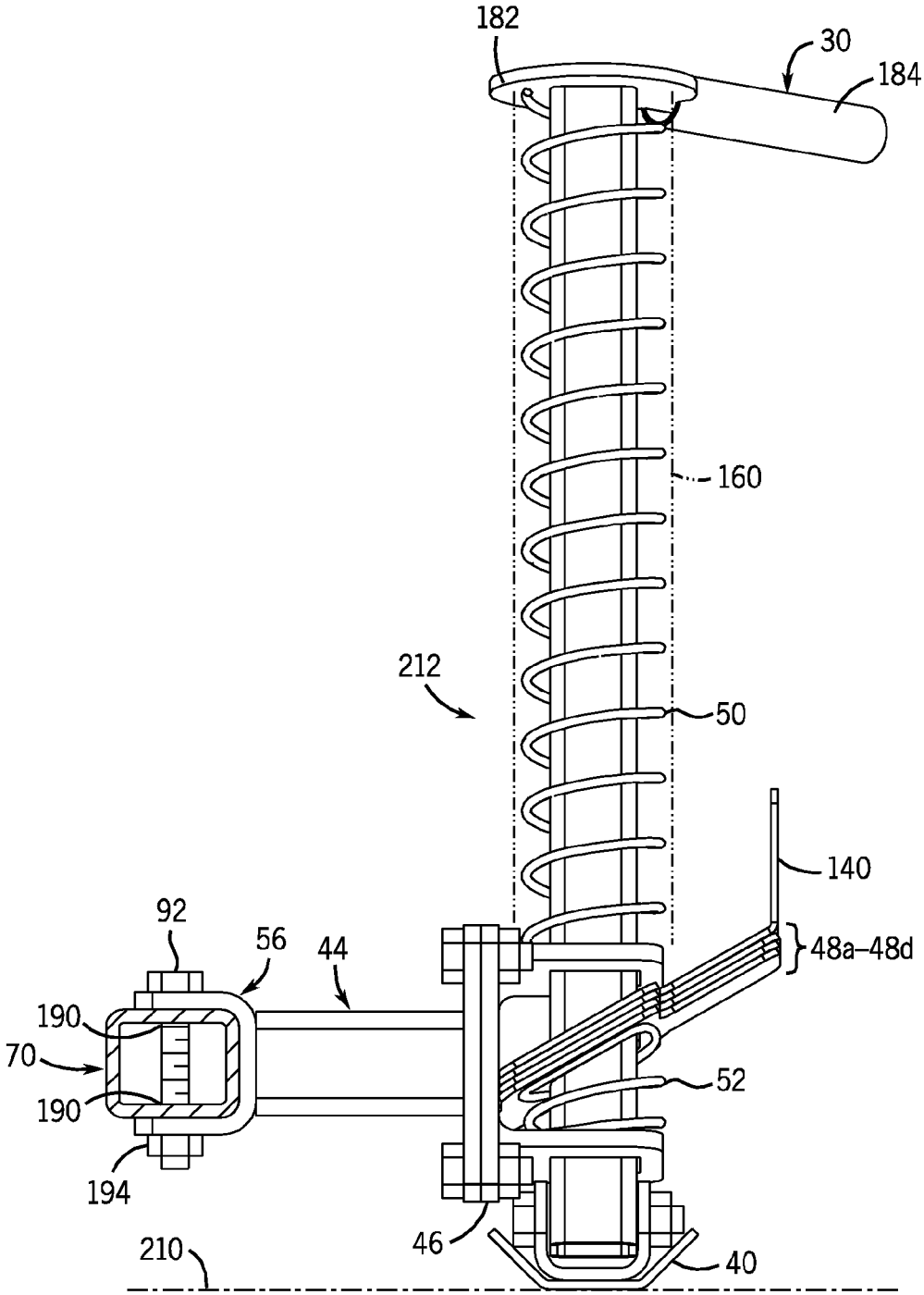
FIG. 7 is partial side view of the snow plow jack stand illustrated in FIGS. 1 through 6, shown in a raised, storage position.

As illustrated in FIG. 7, the jack stand 30 has a raised, storage position 212, wherein the stand base is spaced apart from the ground, after installation of the hitch mechanism on to the plowing vehicle. The spring 52 provides upward pressure on the locking plates 48*a* through 48*d* and they are disposed at an angle, so that the edges 144*a* through 144*d* of the openings 142*a* through 142*d* contact and grip the side edges 133 of the shaft 42, locking the vertical shaft 42 in place, as illustrated in FIG. 8.

It will be appreciated that the jack stand 30 of the present invention is configured to remain in a locked position as a fail safe. More particularly, unless there is downward pressure applied upward pressure applied to the handle 184 or handle 140, the jack stand is in a locked position, so that the edges 144*a* through 144*d* of the openings 142*a* through 142*d* contact and grip the perimetral side edges 133 of the shaft 42, locking the vertical shaft 42 in place, as illustrated in FIG. 8.

When downward pressure is applied to the handle 182 or to the handle 140 on the locking plate 48*a*, the locking plates 48*a* through 48*d* pivot downwardly. As illustrated in FIG. 9, this action releases the vertical shaft, so that the edges 144*a* through 144*d* of the openings 142*a* through 142*d* no longer contact the side edges 133 of the shaft 42. When the locking plates are pivoted in this manner, a space 214 is provided between the side edges 144 of the openings 142 in the locking plates and the shaft 42 may slide up and down within the openings thereof.

Figure 5:
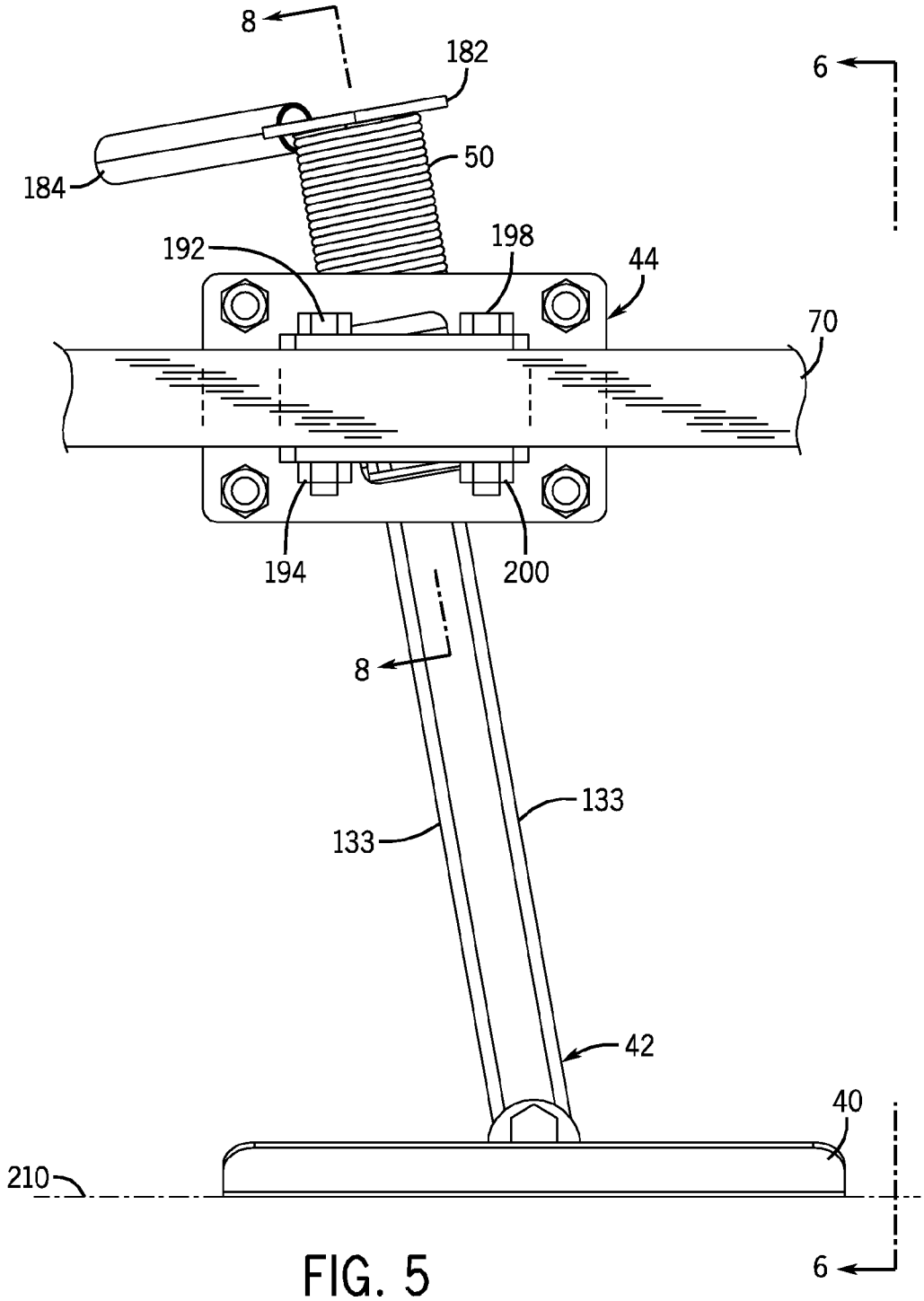
FIG. 5 is partial, rear view of the snow plow jack stand illustrated in FIGS. 1 through 4, taken along the line 5-5 in FIG. 1.

Accordingly, as illustrated in FIGS. 5 and 6, to maintain the plow hitch mechanism 32 at the desired vertical position, the operator applies downward pressure to the handle 184, causing the locking plates 48*a* through 48*d* to pivot downwardly so that the edges 144*a-d* of the openings 144*a-d* are out of contact with the edges 133 of the vertical shaft 42. The shaft 42 is pressed downwardly until the standbase contacts the ground. As soon as pressure is released from the handle 184, upward pressure from the spring 52 on the locking plates 48*a*-48*d* pivots the locking plates back into contact with the edges 133 of the shaft 42, providing the jack stand 30 with its lowered, operational position.

When it is desired to release the jack stand 30, downward pressure is applied to the handle 140 of the top locking plate 42*a*, releasing contact of the locking plates 48*a*-48*d* with the vertical shaft 42. Spring 50 then releases from its tensioned or compressed position, causing the jack stand 30 to return to its raised, storage position 212.

The snow plow jack stand of the present invention are of a construction which is both durable and long lasting, and which will require little or no maintenance to be provided by the user throughout its operating lifetime. The snow plow jack stand is also of inexpensive construction to enhance its market appeal and to thereby afford it the broadest possible market. Finally, all of the aforesaid advantages and objectives of the snow plow blade and wing extensions of the present invention are achieved without incurring any substantial relative disadvantage.

Although the foregoing description of the snow plow jack stand of the present invention have been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow plow jack stand configured to mount to a substantially horizontal hitch frame brace to maintain the hitch frame at the proper vertical position with respect to the ground, the jack stand comprising:

a bracket having a mounting end configured to secure to the horizontal hitch frame brace and a support end comprising upper and lower horizontally oriented, spaced apart plates, and a substantially vertical plate connecting the upper and lower plates, wherein each of the upper and lower plates include an opening formed therein, the upper and lower openings are positioned to axially align with each other, and wherein the vertical plate includes a vertically oriented aperture formed therein;

a plurality of locking plates, each locking plate including a lip extending from a first edge thereof, a tab extending from an opposite edge thereof, and an opening having perimetral side edges formed therebetween, the plurality of locking plates configured to substantially overlie each other so that the openings of each locking plate are substantially axially aligned and such that the lips of each of the locking plates also substantially overlie each other; wherein the overlying lips of the plurality of locking plates are pivotally secured inside the aperture in the vertical plate of the bracket and positioned between the upper and lower plates thereof;

a lower spring member having a first end, and second end and a spring opening, positioned between the upper and lower plates of the bracket underneath the plurality of locking plates;

an upper spring member including a spring opening positioned on a top surface of the upper plate of the bracket;

a substantially vertical, elongated shaft including a top end, perimetral side edges, and a bottom end, the bottom end of the elongated shaft extending through the spring opening of the upper spring, the upper opening of the upper plate of the bracket, each of the openings in the plurality of plates, the spring opening of the lower spring and the lower opening of the lower plate;

the jack stand having a first lowered position, wherein the bottom end of the shaft is resting on the ground, wherein the lower spring pivots the tabbed ends of the plurality of locking plates upwardly at an angle, such that the perimetral side edges of the openings in each of the plurality of locking plates contact the perimetral side edges of the shaft and locks the bracket in place on the shaft the proper vertical position; and the jack stand also having a second raised position, wherein the lower spring is slightly compressed such that the tabbed ends of the plurality of locking plates pivots downward moving the perimetral side edges of the shaft out of contact with the perimetral side edges of the locking plates, permitting the bottom end of the vertical shaft to move out of contact with the ground.

2. A jack stand of claim 1, wherein mounting end of the bracket comprises a horizontally oriented U-shaped channel having top and bottom arms configured to mount top and bottom surface of the hitch frame brace, respectively.

3. A jack stand of claim 1, wherein the support end of the bracket comprises a U-shaped channel member.

4. A jack stand of claim 1, wherein the bracket includes an extension member disposed between the mounting end and the support end.

5. A jack stand of claim 1, wherein the mounting end and the support end of the bracket are formed in two pieces and secured together with bolts.

6. A jack stand of claim 1, further comprising a jack stand pivotally secured to the bottom end of the shaft.

7. A snow plow jack device configurable between a lowered, operational position and a raised, storage position, the snow plow jack device comprising:

a mounting bracket having spaced upper and lower arms securably coupled to the hitch frame;

a support bracket comprising a U-shaped channel having upper and lower horizontally oriented arms and a vertical back plate connecting the upper and lower arms, the upper arm having an upper opening formed therein, the lower arm having a lower opening axially aligned with the upper opening formed therein and the vertical back plate including an aperture formed therein;

at least one locking plate having a first tab extending outwardly from a first edge thereof and a second tab extending outwardly from a second, opposite edge thereof, the locking plate between the upper and lower arms of the support bracket, such that the first tab is securably positioned within the aperture of the vertical back plate whereby the locking plate pivots thereabout, the locking plate further comprising an aperture having perimetral side edges, the apertures configured to align with the upper and lower openings in the support bracket;

a lower tension member having a central opening positioned between the locking plate and the lower arms of the support bracket, the tension member disposed in a tensioned state so that the second tabbed end of the locking plate is pivoted upwards at an angle with respect to the lower arms of the support bracket;

a vertical shaft member including an upper tension member disposed at a top end thereof, the vertical shaft also having an outer surface and a bottom end extending through the upper opening of the upper plate of the bracket, the opening in the locking plate, the central opening of the lower tension member and the lower opening of the lower plate; and a stand pivotally secured to the bottom end of the shaft member, wherein in the lowered, operational position the stand is resting at ground, the upper tension member is in its expanded, tensioned position, and the lower tension member forces the perimetral sides edges of the opening of the locking plate in contact with the outer surface of the shaft member and wherein in the raised, stored position, the stand is spaced apart from the ground, the upper tension member is in its retracted position, and the lower tension member forces the perimetral sides edges of the opening of the locking plate in contact with the outer surface of the shaft member.

8. A jack device of claim 7, wherein mounting bracket comprises a horizontally oriented U-shaped channel having top and bottom arms configured to mount to the plow hitch frame.

9. A jack device of claim 7, wherein the mounting bracket and the support bracket secured together with bolts.

10. A jack device of claim 7, wherein the second tab of the locking plate comprises a release handle, wherein downward pressure on the release handle moves the perimetral side edges of the opening of the locking plate out of contact with the outer surface of the shaft member.

11. A jack device of claim 7, wherein the upper and lower tension members comprise springs.

12. A jack device of claim 7, wherein the top end of the shaft member further comprises a handle.

13. A jack device of claim 7, further comprising at least three locking plates, each of the locking plates substantially overlapping each other.

14. A jack device of claim 7, further comprising a protective sleeve encompassing the upper tension member.

* * * * *